United States Patent [19]

Vanotti

[11] Patent Number: 5,042,717

[45] Date of Patent: Aug. 27, 1991

[54] STRAP FOR THE QUICK FASTENING OF A RAILROAD RAIL AND TIE EQUIPPED WITH SUCH A STRAP

[75] Inventor: Gérard Vanotti, Maillat, France

[73] Assignee: Etablissements Vape, France

[21] Appl. No.: 442,580

[22] Filed: Nov. 28, 1989

[30] Foreign Application Priority Data

Dec. 2, 1988 [FR] France ..... 88 15851
Oct. 10, 1989 [EP] European Pat. Off. ..... 89810764.4

[51] Int. Cl.[5] ..... E01B 9/48; E01B 9/60

[52] U.S. Cl. ..... 238/349; 238/355; 238/377

[58] Field of Search ..... 238/310, 315, 338, 341, 238/349, 351, 297, 343, 345, 347, 352, 353, 354, 355, 356, 357, 361, 364, 366, 370, 371, 377; 24/698

[56] References Cited

U.S. PATENT DOCUMENTS 4,927,078 5/1990 Vanotti ..... 238/349

FOREIGN PATENT DOCUMENTS 761893 11/1956 United Kingdom ..... 238/349
2045320 10/1980 United Kingdom ..... 238/349

*Primary Examiner*—Frank E. Werner
*Assistant Examiner*—James T. Eller
*Attorney, Agent, or Firm*—Kane, Dalsimer, Sullivan, Kurucz, Levy, Eisele and Richard

[57] ABSTRACT

Fastening strap composed of a rod having a vertical rectilinear part (20) and a curved part which forms a spring and the end (10) of which grips the flange (25) of the rail to be fastened, after being tensioned as a result of the rotation of the strap above a ramp (30), the lower end of the rectilinear part being equipped with a heel (2) catching on a retaining surface (36) in the tie. The strap has an intermediate bearing point (6) which, during the rotation of the strap, bears on an abutment (38) or on a bearing surface of a metal sole plate. This intermediate bearing point ensures the stability of the strap during its rotation and in its tensioned position and, if an abutment is used, keeps this abutment in place.

17 Claims, 7 Drawing Sheets

STRAP FOR THE QUICK FASTENING OF A RAILROAD RAIL AND TIE EQUIPPED WITH SUCH A STRAP

FIELD OF THE INVENTION

The subject of the present invention is a strap for the quick fastening of a railroad rail to ties or stringers made of concrete, wood, plastic or metal, the said strap being composed of a steel or reinforced plastic rod having a vertical rectilinear part terminating in an eccentric heel intended for interacting with a catching means associated with the tie or with a metal sole plate fastened to the tie, and a curved part which forms a spring and the end of which is intended to press onto the flange of the rail after the rotation of the rod about its vertical part, during which rotation the said end moves on a ramp intended for tensioning that part of the strap forming a spring and for leading it onto the flange of the rail.

PRIOR ART

A strap of this type is described in the Patent Application FR 2,608,182. For fastening a rail to a concrete tie without a metal pad, the strap is used together with a plastic abutment pierced with a hole which the rod of the strap passes through. For fastening a rail to a metal pad, this strap is used without an abutment. In both cases, once the bearing end of the strap has been brought onto the flange of the rail, the tension on the strap tends to cause the latter to tilt, so that its rectilinear rod comes to bear against the edge of the hole in the abutment or in the metal pad. Although this torsion is not particularly troublesome where a metal pad is concerned, in contrast it has disadvantages with regard to a strap used with a plastic abutment. To overcome this disadvantage, the upper edge of the hole in the abutment has been reinforced by means of a collar. The abutment nevertheless tends to lift as a result of tilting about its outer edge and, on the other hand, instead of exerting a vertical pressure on the concrete of the tie, it exerts a transverse pressure against the side wall of its receptacle in the concrete. Such a stress on the concrete can cause the concrete to crack. Moreover, the abutment has to withstand compressive and torsional forces which are difficult to control.

The object of the present invention is to provide a fastening strap overcoming the abovementioned disadvantages, whilst at the same time preserving the simplicity of the prior strap. More specifically, the object of the invention is to provide a fastening strap which exerts a vertical pressure on the abutment or on the metal pad at all times and the rod of which does not tilt and does not come to bear against the edge of the hole in the abutment or in the metal sole plate.

SUMMARY OF THE INVENTION

The strap according to the invention is characterized in that the curved part of the rod of the strap has a form both undulated vertically and wound about the vertical part of the rod, in such a way that it has an intermediate bearing point formed by the bottom of the first undulation and a main bearing point located near the end of the rod, these two bearing points being mutually opposite in relation to the vertical part, but at different distances from this vertical part, the radius of revolution of the intermediate bearing point being substantially smaller than the radius of revolution of the main bearing point.

Since the strap always bears at two mutually opposite points in relation to the rectilinear part of the strap, this part maintains a vertical position. When the strap is used with an abutment, the intermediate bearing of the strap exerts on the abutment a vertical force which results in a favorable compression of the concrete of the tie in the zone absorbing the lateral forces of the rail.

The strap according to the invention can supplied together with its abutment, to form a device for fastening a rail to a concrete tie. Another subject of the invention is such a fastening device, characterized in that the perimeter of the upper face of the abutment is contained between the circle of revolution of the intermediate bearing point and the circle of revolution of the main bearing point.

Another subject of the invention is a concrete railroad tie equipped with such fastening devices, this tie having, for each rail, a recess intended for receiving the rail and two receptacles which are laterally adjacent to this recess and in which the abutments of the fastening devices are seated, the concrete having a ramp extending at least between that edge of the said receptacles opposite the recess intended for the rail and the edge of this recess, these ramps forming the ramps intended for tensioning the straps, and means embedded in the concrete for the retention of the rods of the straps.

Another subject of the invention is a stringer made of concrete, especially reinforced concrete, and equipped with metal supports in the form of a rectangular bow, to which the abutments made of synthetic material are fastened at the workshop or on site.

Another subject of the invention is a metal sole plate for a railroad tie equipped with straps according to claim 1, the rods of which pass through holes provided in the pad and catch on countersinks into which the said holes open, the sole plate having a receptacle intended for receiving the rail and, on each side of this receptacle, ramps the extension of which coincides with the flange of the rail, characterized in that the said ramps have the form of a path in an arc of a circle, the mean radius of which is equal to the radius of revolution of the main bearing point of the straps. The start of the ramp can correspond to the point of temporary fastening of the strap to the sole plate.

Furthermore, the fastening strap is advantageously equipped with a profiled piece made of synthetic material, serving for plugging that part of the hole used for the passage of the eccentric catching heel of the strap and for guiding its vertical rectilinear part during its rotation.

An exemplary embodiment of the strap and examples of the use of this strap will now be described with reference to the accompanying drawing.

DESCRIPTION OF THE PREFERRED EMBODIMENTS

Figure 3:
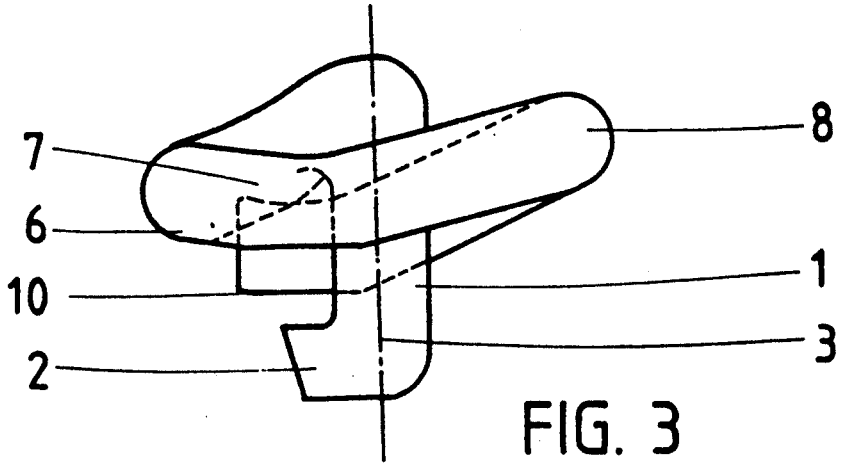
FIG. 3 is a side view of this strap in the direction A of FIG. 1, that is to say in a position rotated through 90° in relation to FIG. 1.
Figure 1:
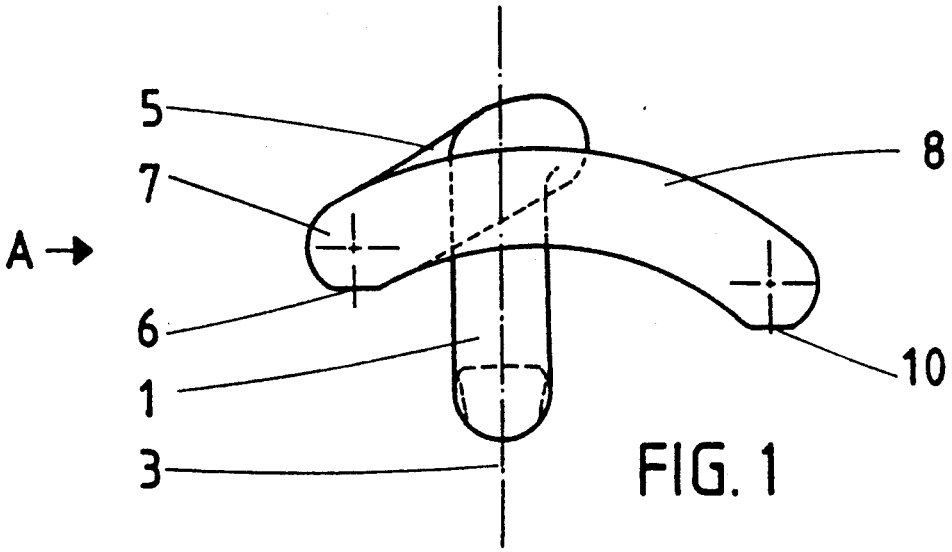
FIG. 1 is a first elevation view of the fastening strap.
Figure 2:
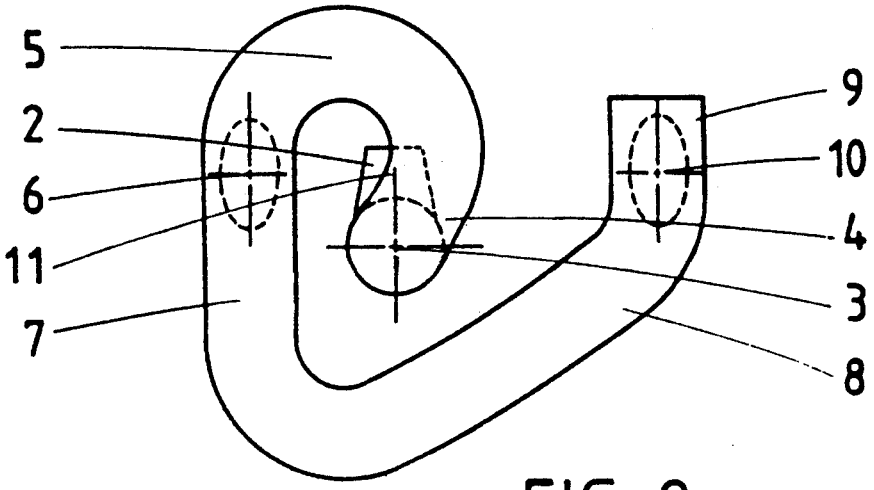
FIG. 2 is a plan view of this same fastening strap.

The strap illustrated in FIGS. 1 to 3 is composed of a steel rod of circular cross-section, having a vertical rectilinear part 1 equipped, at its base, with a heel 2 directed perpendicularly relative to the axis 3 of this rectilinear part. The steel rod has a form both undulated vertically and wound about the axis 3 of the vertical part. The undulated part is composed of a short rising part 4, rectilinear as seen in horizontal projection (FIG. 2), followed by a falling part 5 extending over a little more than a semicircle, as seen in horizontal projection, a first low point 6 constituting an intermediate bearing point and followed by a rising part 7, first rectilinear, as seen in horizontal projection, and then rounded, at the same time passing via a high point, to fall again in a longer undulation 8 of low curvature, terminating at the bottom of the undulation in a bent part 9 parallel to the part 7, as seen in horizontal projection, and constituting a main bearing point 10. The bearing points 6 and 10 have flats intended for reducing the wear of both the strap at its bearing points and the parts on which it bears. The bearing points 6 and 8, as seen in plan view, that is to say in the direction of the axis 3 (FIG. 2), are mutually opposite diametrically in relation to the middle 11 of the catching heel 2. In this same view, the axis 3 of the rectilinear part is located substantially at the center of the triangle formed by the parts 7 and 8 of the rod and by the straight line connecting the bearing points 6 and 10. It will be seen later that this arrangement directs the forces in a suitable way and ensures that the strap has a high stability. The vertical rectilinear part 1 can be of greater or lesser length, depending on the type of tie on which it is to be used. It will be seen that the main bearing point 10 and the intermediate bearing point 6 are not at the same level, the bearing point 10 being approximately 1 cm lower than the bearing point 6.

Figure 4:
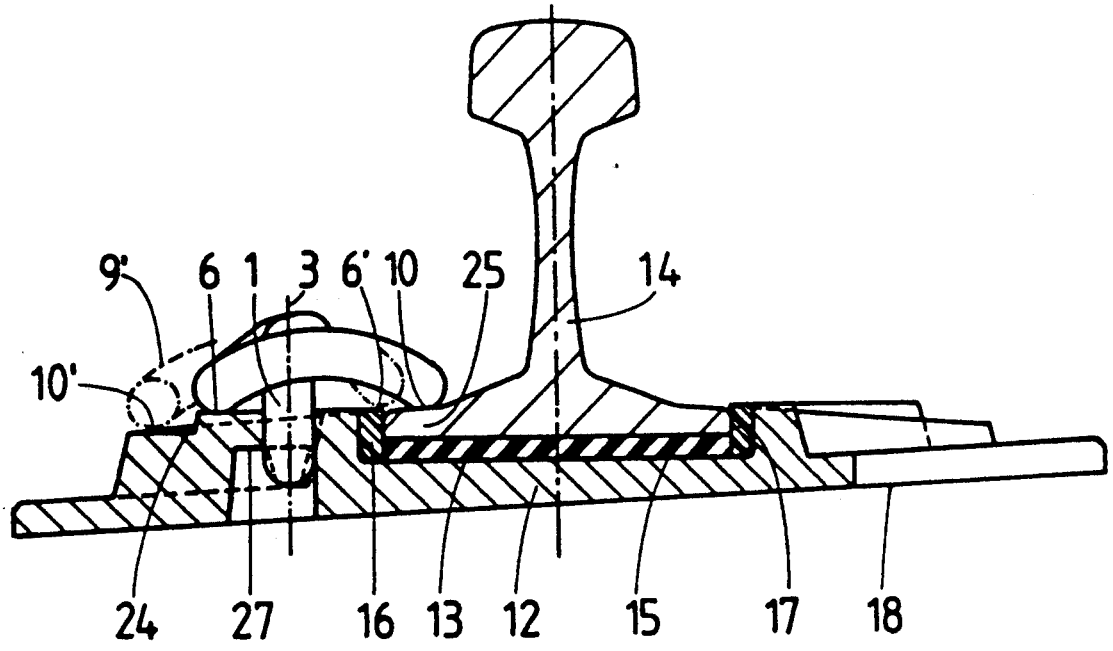
FIG. 4 is an elevation view of a metal sole plate equipped with a fastening strap according to the invention.
Figure 5:
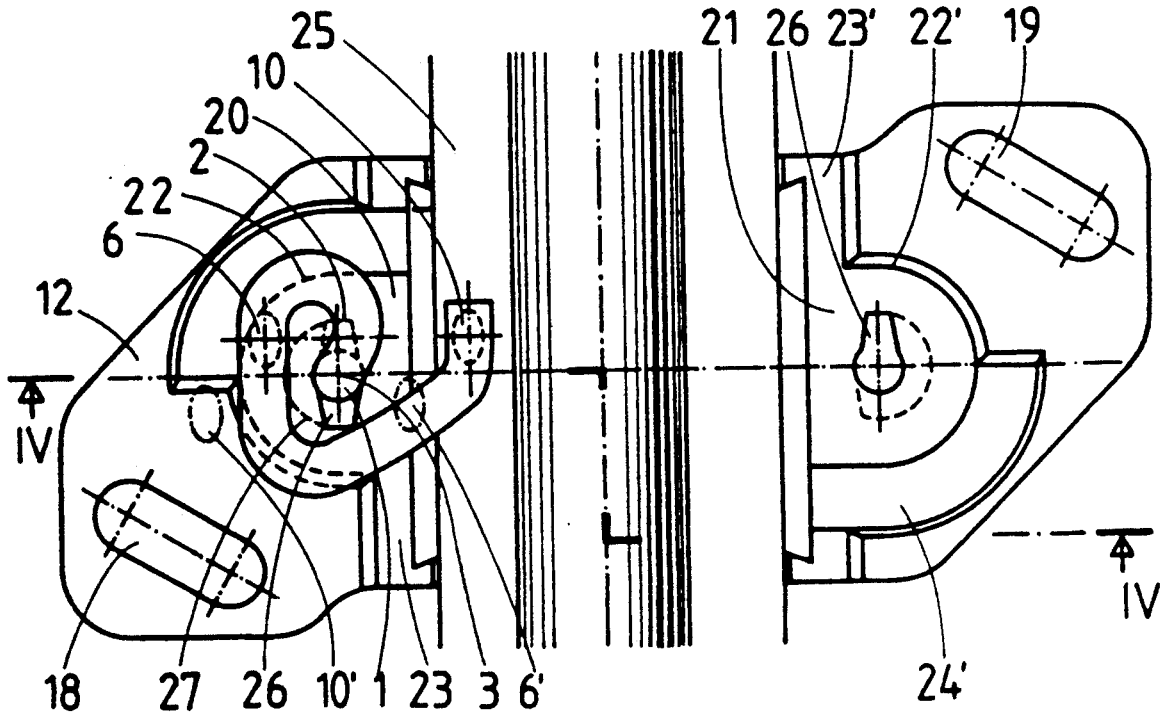
FIG. 5 is a plan view of this same metal sole plate.

The use of the fastening strap illustrated in FIGS. 1 to 3 for the fastening of a rail by means of a metal sole plate will now be described with reference to FIGS. 4 and 5.

These figures show a metal sole plate 12 having a recess 13 intended for receiving a rail 14, with an elastic pad 15 made of rubber and two lateral abutments 16 and 17 made of plastic being interposed. The lower face 18 of the metal sole plate 12 is inclined slightly, since it is intended to fastened to a concrete tie having an inclined plane. For this purpose, the metal sole plate 12 has two oblong holes 18 and 19 intended for receiving tie screws which are preferably screwed into PLASTIRAIL (registered trade mark) anchoring sockets embedded in the concrete. On each side of the recess 9, the sole plate 12 has two plane bearing surfaces 20 and 21 intended for receiving the fastening straps. Only the bearing surface 20 need be described in detail, the bearing surface 21 being identical to the bearing surface 20, but arranged upside down in relation to the rail. The bearing surface 20 is plane and horizontal. It has a part of circular contour 22 and a rectilinear part 23 extending along the recess 13. Round the plane part 20 there extends, over a quarter circle, a ramp 24 in the form of a path rising progressively in the direction of the rail 14. The top of this ramp 20 is level with the edge of the flange 25 of the rail. The middle of the plane part 20 is pierced with a hole 26, the form of which matches the form of the profile of the rectilinear part 1 of the strap and of the heel 2, as seen in the plan view of FIG. 2, there being the play necessary for the free insertion of the rectilinear part 1 of the strap into this hole 26. The hole 26 opens into a countersink 27 made in the lower face of the sole plate 12.

The fastening strap is installed in the position represented by dot-and-dash lines, that is to say in a position rotated through 180° about the axis 3 in relation to the position represented by unbroken lines. In this position, the catching heel 2 can be introduced freely into the hole 26. The main bearing point 10 is in a position 10' outside the ramp 24, and the catching heel 2 is very slightly below the countersink 27. As a result of a slight rotation of the strap, simultaneously the main bearing point 10 of the strap is brought onto the ramp 24 and the heel 2 of the strap is brought up against the countersink 27. As a result of an additional slight rotation of the strap, the latter is given a slight tension sufficient to fasten the strap temporarily to the metal sole plate 12. This position is designated by 10''. The metal sole plate can thus be supplied equipped with the fastening straps, the straps being held sufficiently for transport and placing on the track. Once the metal sole plate is fastened to the tie and the rail 14 placed in its receptacle, each of the fastening straps is driven in rotation, in such a way that its main bearing point 10 moves along the ramp 24, the mean radius of which is equal to the radius of revolution of the bearing point 10 about the axis 3. As regards the intermediate bearing point 6, this moves on the horizontal plane surface 20. The bearing point 10 finally comes to bear on the flange 25 of the rail, at the same time exerting a pressure of the order of 10 to 12 kN. Furthermore, the strap bears on the bearing surface 20 of the sole plate by means of its intermediate bearing point 6, thereby exerting a vertical pull on the catching heel 2 via the rectilinear part 1 of the strap. The countersink 27 extends approximately over a semicircle, in such a way that the heel comes up against the end of this countersink, thus limiting the rotation of the fastening strap. It is possible to provide a notch in the countersink 27, so that the catching heel 22 is locked in this countersink, thereby preventing the removal of the strap, once the rail has been fastened. In the right-hand portion of FIG. 5, some parts corresponding to the left-hand portion have been designated by the same references accompanied by the sign '.

The arc of rotation of the strap between the installation position and the rail-fastening position need not necessarily be 180°, but can be less than or more than 180°.

Figure 6:
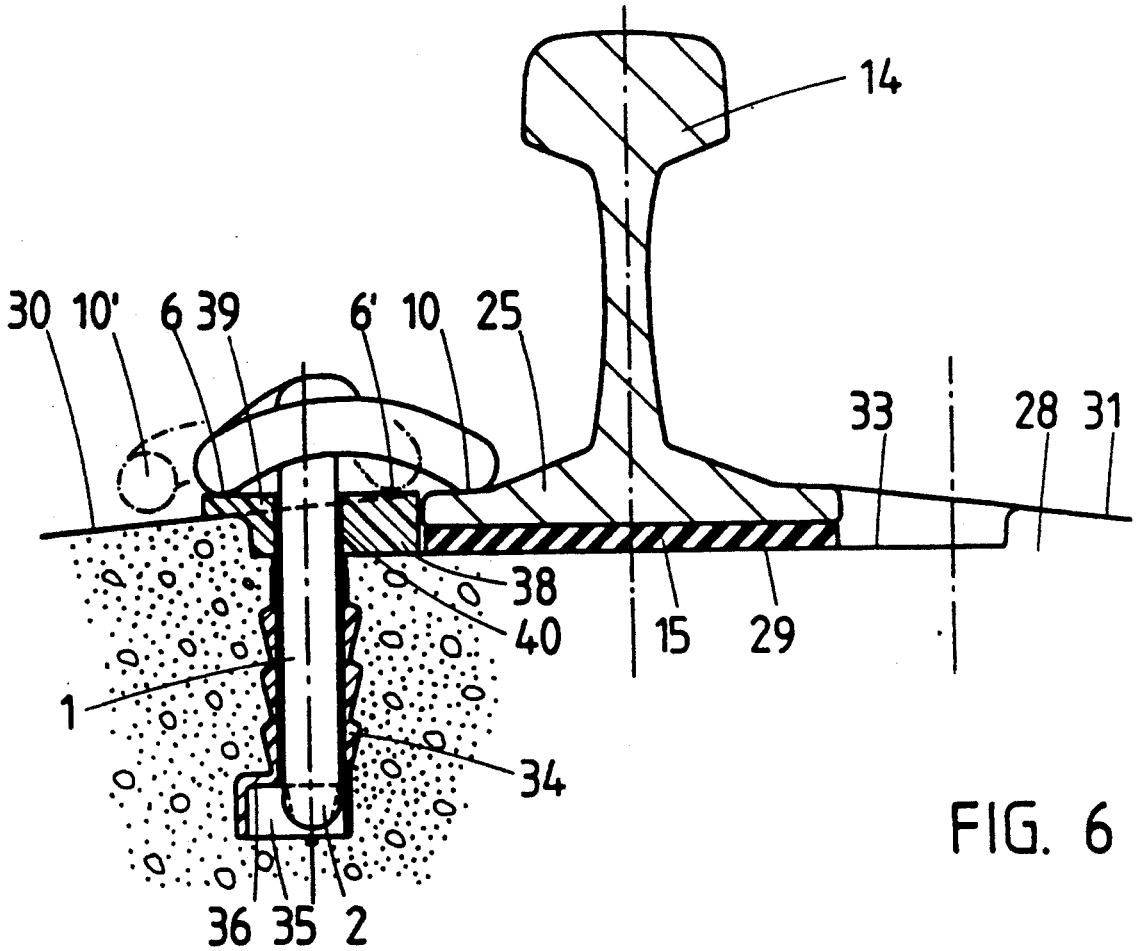
FIG. 6 is a partial sectional view of a concrete tie equipped with a fastening strap according to the invention, according to a first embodiment.
Figure 7:
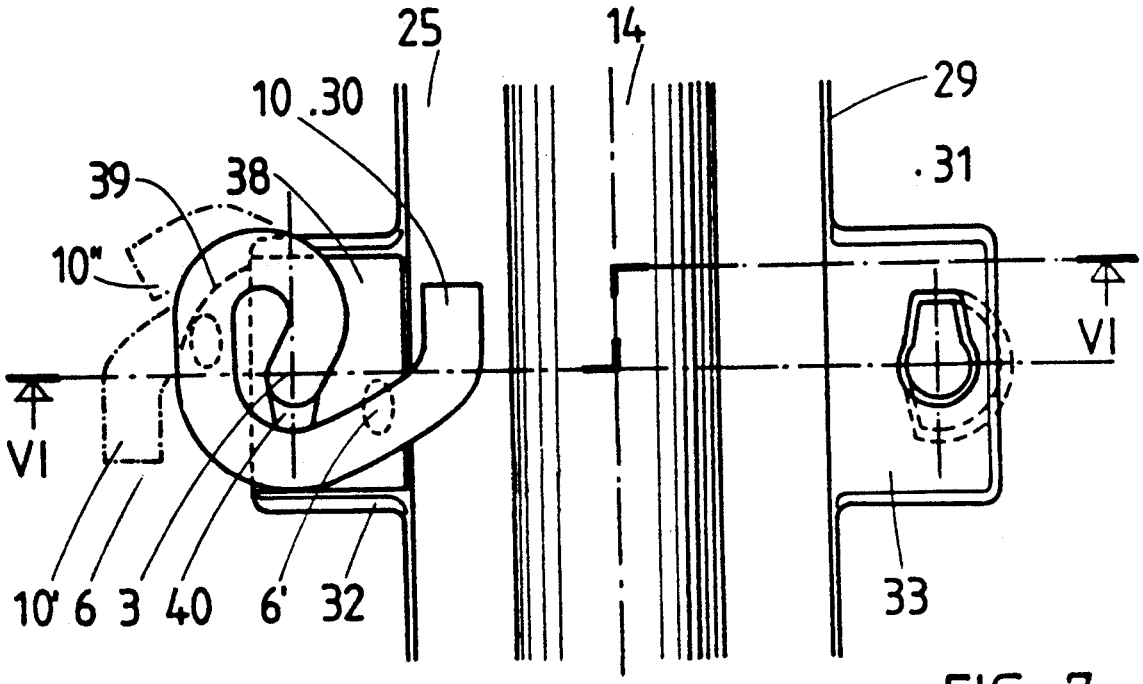
FIG. 7 is a partial plan view of this same concrete tie.
Figure 8:
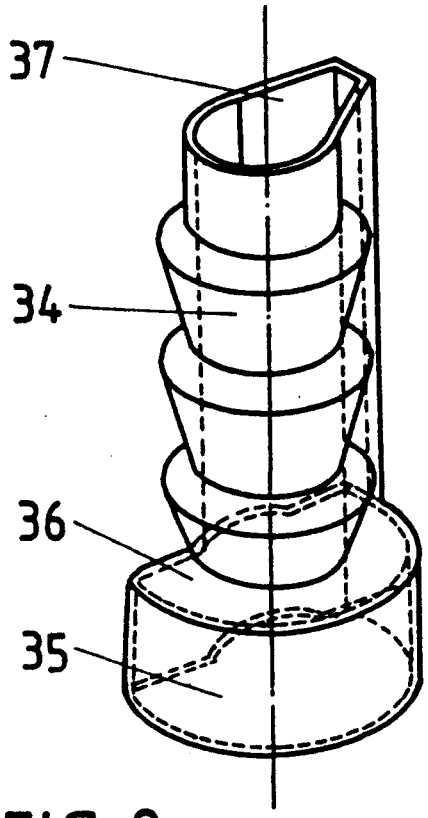
FIG. 8 is a perspective view of the anchoring socket embedded in the concrete.
Figure 9:
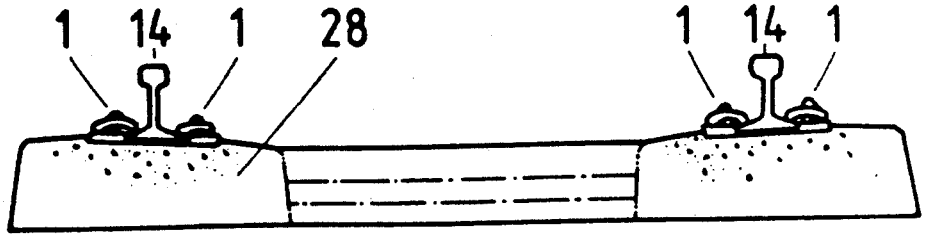
FIG. 9 shows a complete tie with the rails fastened.
Figure 13:
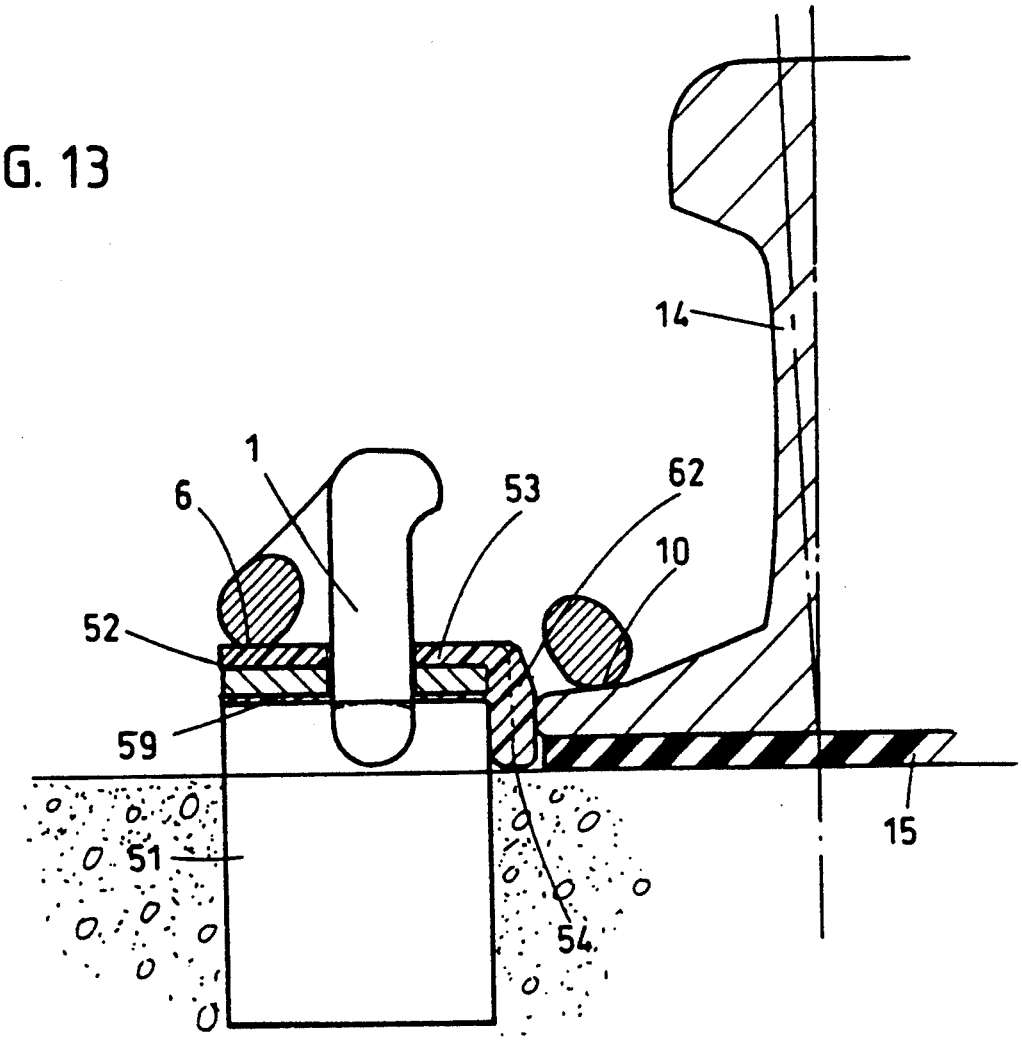
FIG. 13 is a partial view, in section according to XIII—XIII of FIG. 15, of a concrete stringer equipped with a fastening strap and with a rail, according to a second embodiment.
Figure 14:
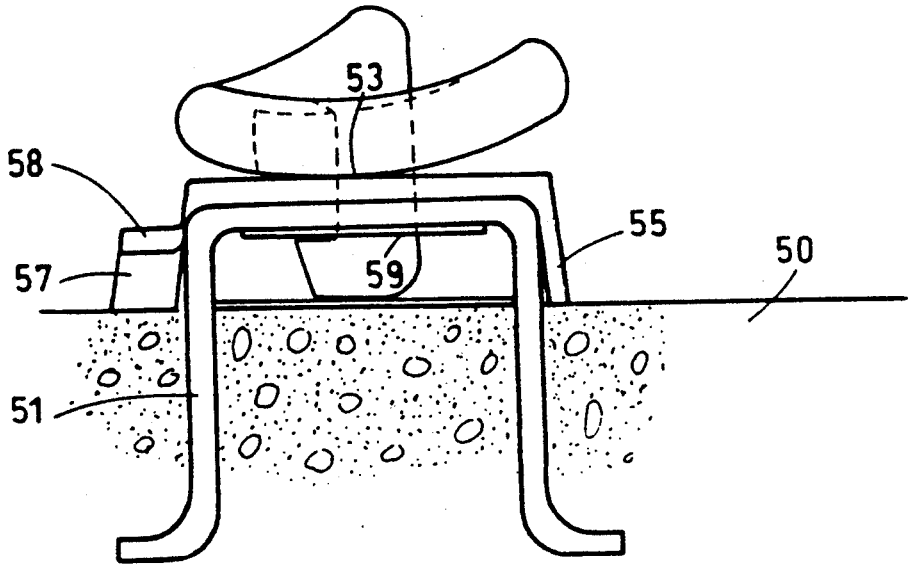
FIG. 14 is a side view in section according to XIV—XIV of FIG. 15.
Figure 15:
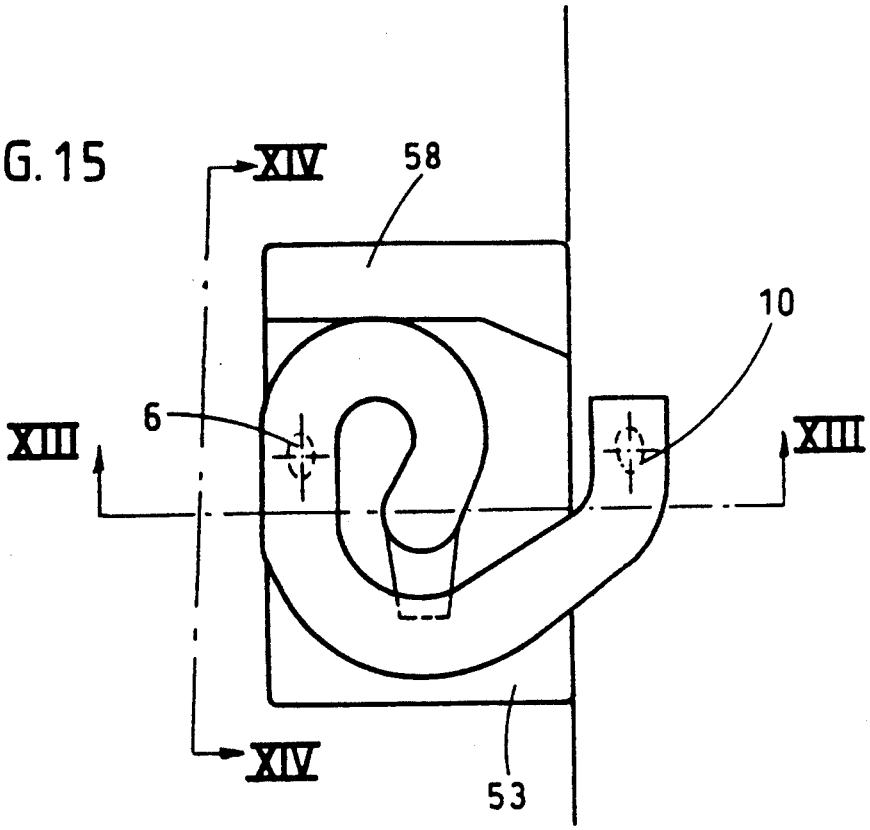
FIG. 15 is a plan view of the stringer of FIG. 13.

The use of a fastening strap according to the invention for fastening a rail to a concrete tie 28 without a metal sole plate will now be described by means of FIGS. 6 and 7. This concrete tie can be made completely of concrete or be composed of two concrete blocks connected by means of a metal rod, as illustrated in FIG. 9. FIGS. 6 and 7 show only part of the tie, that is to say the part corresponding to a rail. For each of the rails, the tie 28 has a recess 29 intended for receiving the rail. On each side of this recess 29, the tie 28 has two ramps 30 and 31 descending away from the recess 29. On each side of the recess 29, the tie 28 also possesses two rectangular receptacles 32 and 33, the bottom of which is at the same level as the bottom of the recess 29 and which communicate with this recess. Two profiled sockets 34 made of synthetic material and surrounded by metal are embedded in the concrete. These sockets have the same composition and the same external form as the PLASTIRAIL (registered trade mark) sockets serving for the fastening of the tie screws and described in the French Patent Application No. 88.12,185. These sockets 34, at their base, have a widening 35 forming a countersink 36 intended for performing the same function as the countersink 27 of the metal sole plate. The socket 34 is shown in perspective in FIG. 8. Above the widening 35, the socket has a profile 37 matching the profile of the catching heel 2 of the fastening strap. In this embodiment, the fastening strap has a rectilinear part 1 substantially longer than the strap illustrated in FIGS. 1 to 3, so as to be capable of catching at the bottom of the socket 34. Of course, the sockets 34 open out into the bottom of the receptacles 32 and 33. The fastening strap is mounted together with an abutment 38, made of synthetic material, inserted between the curved part of the strap and the concrete. This abutment 38 has the form of a rectangular parallelepiped extended laterally by a bearing surface 39 which is in the form of an arc of a circle and which extends the plane upper face of the abutment and engages on the bottom of the receptacle 32 in a stepped manner. The general form of the abutment 38 corresponds to the form of the receptacle 32 in which this abutment is seated. The abutment 38 has a profiled hole 40 allowing the passage of the catching heel 2 of the strap. The perimeter of the abutment 38 is contained between the circle of revolution of the intermediate bearing point 6 and the circle of revolution of the main bearing point 10, in such a way that this main bearing point 10 is always outside the abutment.

The fastening strap equipped with its abutment 38 is first introduced into the socket 34 in the position represented by dot-and-dash lines 6', 10', that is to say in a position rotated through 180° in relation to the position represented by unbroken lines. In this position, the main bearing point 10' is 1 or 2 mm from the surface of the concrete on the ramp 30. As a result of a slight rotation of the strap in the clockwise direction, the heel 2 of the strap engages under the countersink 36. As a result of an additional slight rotation, the main bearing point 10' rises slightly on the ramp 30, the effect of which is to exert some tension on the strap, this tension ensuring the temporary fastening of the strap to the concrete tie. This temporary fastening position is, for example, the position 10''. The tie can therefore be equipped with the fastening straps at the factory. To fasten the rail 14, it is sufficient to continue rotating the strap. During this rotation, the main bearing point 10 rises progressively on the ramp 30 of the concrete, the end of which is level with the flange 25 of the rail. The main bearing point 10 comes to bear under tension on the flange 25 with a pressure of the order of 10 to 12 kN. The rotation of the abutment is limited by the form of the widening 35 of the socket 34 which forms a stop limiting the rotation of the catching heel 2. During the rotation of the strap, the intermediate bearing point 6 slides on the horizontal surface of the abutment 38, at the same time keeping the rectilinear part 1 of the strap in a vertical position. The strap exerts no lateral pressure on the hole 40 in the abutment 38. In the final position, the intermediate bearing point 6 grips the bearing surface 39 of the abutment against the concrete. The compression of the concrete in this zone is expedient because the concrete can thus better withstand the transverse forces attributable to the lateral pressure exerted by the rail via the abutment 38.

The socket 34 can, of course, also be provided with a locking notch for the heel 2 of the strap, if it is desirable that the latter be unremovable.

The complete tie 28 is illustrated in FIG. 9. A composite concrete/steel tie has been represented by dot-and-dash lines. The tie is equipped with four straps 1. It is supplied equipped with these straps, the temporary fastening of which is sufficient to keep the assembly in place during transport and putting on the track.

Figure 10:
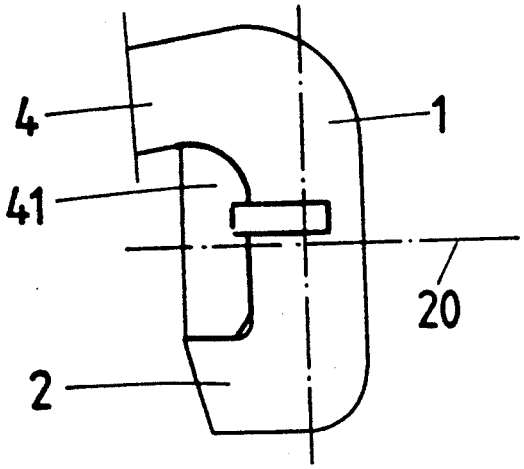
FIG. 10 is a partial view of FIG. 3, showing the strap equipped with an auxiliary closing and guiding piece.
Figure 12:
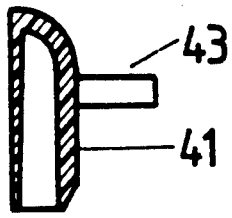
FIG. 12 is a view in vertical section of the auxiliary piece shown in FIGS. 10 and 11.
Figure 11:
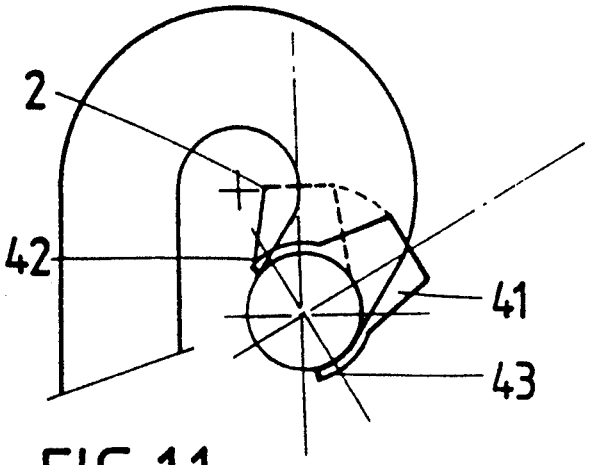
FIG. 11 is a top view of this same strap part.

The hole 26 in the metal sole plate and the hole 40 in the abutment 38 allows sand and dirt to penetrate. FIGS. 10 to 12 show a means of plugging this hole, whilst at the same time ensuring a better guidance of the vertical part 1 of the strap during its rotation. FIGS. 10 and 11 illustrate a part of the strap shown in FIGS. 1 to 3. Fastened to the vertical part 1 between the heel 2 and the first curved part 4 of the strap is a plastic plug 41 which fills the vertical space between the heel 2 and the part 4 and the profile of which fills the profile of the hole 26. This plug 41 is equipped with two curved arms 42 and 43, by means of which the plug 41 is fastened by gripping to the cylindrical part 1 of the strap. The plug 41 is preferably slightly larger than the hole 26 and hollow, as shown by the cross-section illustrated in FIG. 12, so as to have a transverse elasticity in order to plug the hole 26 more effectively. In FIG. 10, dot-and-dash lines also represent the level of the surface 20 of the metal sole plate. When the strap is being introduced into the hole 26, the plug 41 is engaged into this hole 26 together with the rectilinear part of the strap, the assembly as a whole occupying the entire cross-section of the hole 26. During the rotation of the strap, the plug 41 remains in place, serving as a guide for the part 1 of the strap. FIG. 11 shows the strap after some rotation of the latter in relation to the plug 41 retained in the hole 26.

The strap illustrated in FIGS. 6 and 7 and in FIGS. 13 to 17 can, of course, be equipped with a plug similar to the plug 41 and differing from this only in its length.

The form of the undulations of the strap and the form of its heel and of the holes for the passage of this heel can, of course, differ from the forms shown.

The abutment 38 could be larger and have a ramp similar to the ramp 24 for the main bearing point 10 of the strap.

Figure 16:
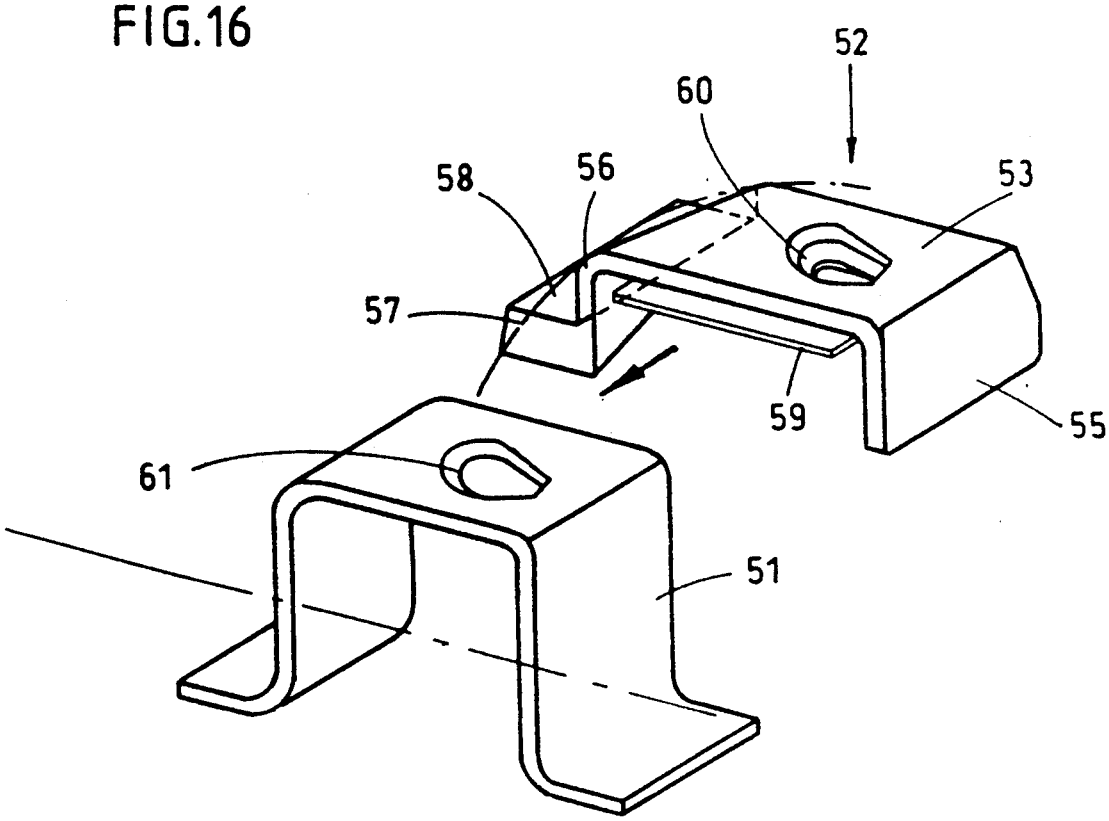
FIG. 16 is an exploded view of the metal support equipping the stringer of FIGS. 13 to 15 and of the abutment.

The rails are sometimes laid on stringers or ties made of prestressed concrete. The manufacture of stringers or ties made of prestressed concrete does not allow the presence of recesses, such as the recesses provided in the ties illustrated in FIGS. 6 and 7. In this case, it is expedient to resort to another solution for fastening the abutments made of synthetic material. FIGS. 13 to 16 illustrate such a solution. Anchored in the prestressed-concrete stringer or tie 50, the surface of which is smooth, are metal supports 51 in the form of a bow of rectangular profile, the lower ends of which are bent to ensure an anchorage in the concrete. An abutment 52 made of synthetic material is mounted on each of the bows 51. In parallel with the profile of the bow 51, this abutment 52 likewise has a bow-shaped profile, as shown in FIG. 16. More specifically, the abutment has a plane upper face 53, a relatively thick side 54 serving as a centering abutment for the rail 14, and two thinner lateral sides 55 to 56 serving for retaining the abutment on the bow 51, the side 56 being equipped with a heel 57, the upper face of which is in the form of a ramp 58 rising towards the part 54. A horizontal wall 59 starting from the part 54 extends between the walls 55 and 56. The distance between the wall 59 and the part 53 of the abutment corresponds to the thickness of the bar forming the bow 51. The stop 52 is slipped laterally onto the bow 51 in the direction of the arrow of FIG. 16, the bow engaging between the part 53 and the wall 59 and between the walls 55 and 56. The abutment 52 is provided with a profiled hole 60 coinciding with a hole 61 of the same profile in the bow 51, for the passage of the strap. The upper portion of the part 54 of the abutment has a chamfer 62. When the abutment 52 is mounted on its support 51, the sides 55 and 56 and the heel 57 are in contact with the stringer 50. The abutment 52 is first equipped with a strap identical to the straps of the preceding figures. As before, the main bearing point 10 of the strap is brought onto the start of the ramp 58 in order to fasten the strap temporarily. After the rail 14 has been installed between these abutments, this being made easier by the chamfers 62, the strap is driven in rotation in such a way that the main bearing point 10 rises on the ramp 58 to the height of the flange and the rail 14. As in the preceding embodiments, the perimeter of the upper face 53 of the abutment is contained between the circle of revolution of the intermediate bearing point 6 and the circle of revolution of the main bearing point 10.

By providing abutments having different thicknesses in the region of the part 54, it is possible, if the appropriate thickness is selected, to wedge the rail perfectly in the lateral direction.

Moreover, the thin wall 59 has the effect of insulating the strap electrically from the metal support 51.

Figure 17:
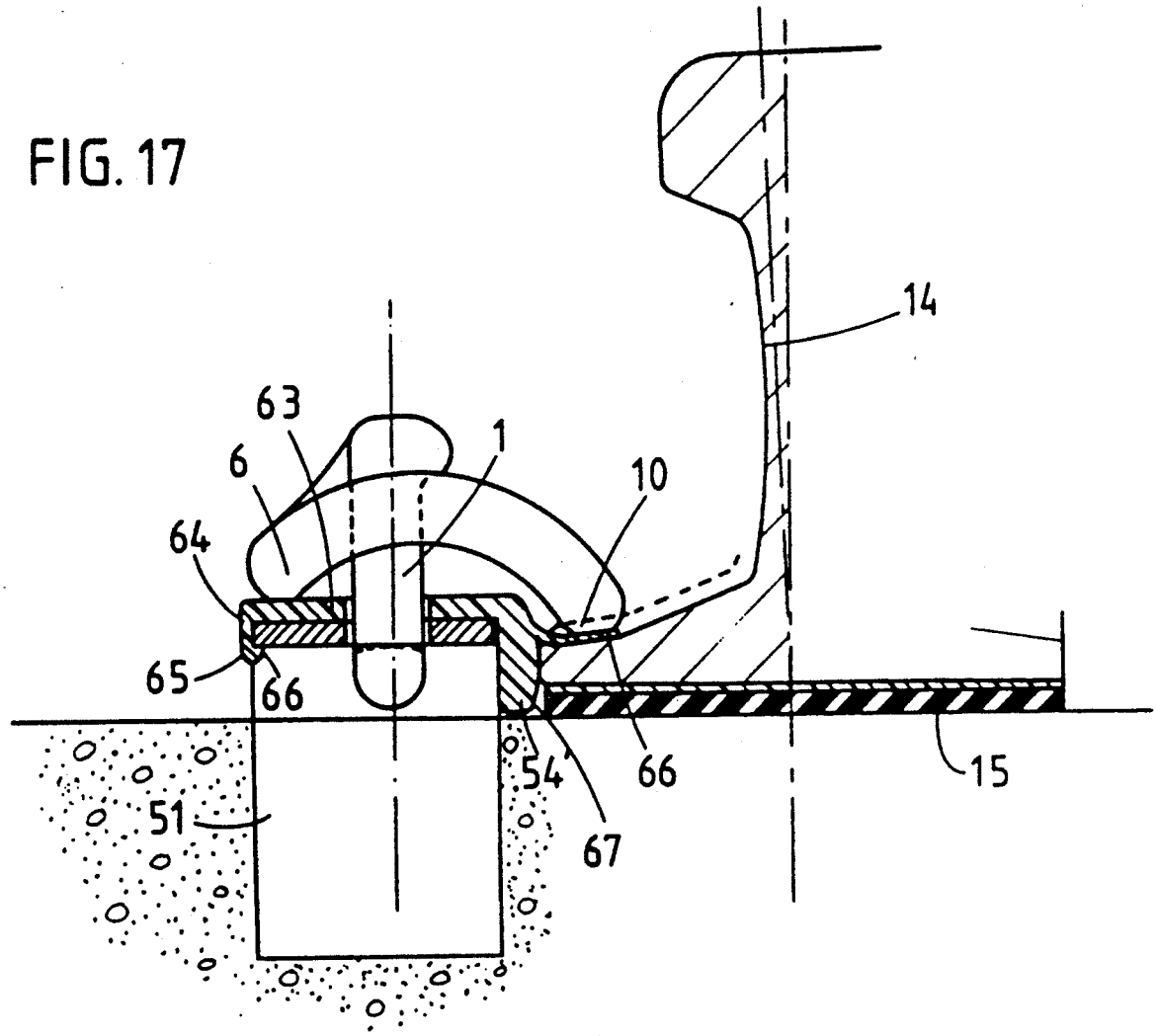
FIG. 17 shows the same stringer equipped with an abutment of a different form.

The abutment described above need not necessarily be mounted upon its metal support 51 before the laying of the rail. FIG. 17 illustrates an alternative embodiment allowing the insulating abutment to be fastened after the laying of the rail. Since the abutment is a wearing part, its replacement can thus be carried out without moving the rail. The abutment 63 differs from the abutment 52 in that the wall 59 is replaced by a rim 64 parallel to the part 54' corresponding to the part 54, this rim 64 terminating in a hook-shaped extra thickness 65 having a chamfer 66. The wall 64 is not connected to the side walls corresponding to the walls 55 and 56 of FIG. 16. The abutment 63 is installed vertically on the metal support 51, a simple pressure on the abutment moving apart elastically the wall 64 which is fastened to the support 51 by snapping.

The abutment 63 is advantageously equipped with a flexible tongue 66 extending laterally from the part 54'. As emerges from the drawing, this tongue 66 is intended to rest on the flange of the rail 14. It is attached to the abutment somewhat high up, in such a way that it can follow the flange of the rail in its descending movement when it is being fastened by means of the strap. The tongue 66 is finally gripped between the flange of the rail and the main bearing point 10 of the strap. The tongue 66 protects the flange of the rail against a punching effect as a result of the friction of the strap and insulates the metal strap electrically from the rail.

The part 54' of the abutment possesses, in its lower part, a chamfer 67 intended to make it easier to introduce this part 54' between the support 51 and the flange of the rail.

In a simplified embodiment, the support 51 and the abutment 52 could be produced in one piece from a ductile material, such as cast iron, graphite cast iron, alloy or composite material. The abutment so obtained takes the form of a piece anchored in the concrete and having a bow-shaped part located above the concrete and intended for the fastening of a strap, such as the strap described.

I claim:

1. A fastening strap for the quick fastening of a railroad rail to ties made of material selected from the group consisting of concrete, wood, plastic or metal, the said strap being composed of a material selected from the group consisting of steel or reinforced plastic, said strap being a rod having a vertical rectilinear part (1) terminating in an eccentric heel (2) intended for interacting with a catching means (27; 34) associated with the tie, and a curved part (4 to 9) which forms a spring and the end (10) of which is intended to press onto a flange of the rail after the rotation of the strap about its vertical part to an installed position, during which rotation the said end moves on a ramp intended for tensioning that part of the strap forming a spring and for leading it onto the flange of the rail, characterized in that the curved part of the strap has a form both undulated vertically and wound about the vertical part (1) of the rod, in such a way that it has an intermediate bearing point (6) formed by the bottom of a first undulation and a main bearing point (10) located near the end of the strap formed by a second undulation, these two bearing points being disposed on mutually opposite sides of the vertical part, and at different distances from this vertical part, the radius of revolution of the intermediate bearing point (6) being substantially smaller than the radius of revolution of the main bearing point (10).

2. Fastening strap as according to claim 1, characterized in that, as seen in the direction of the axis (3) of the vertical rectilinear part, the bearing points (6 and 10) are disposed on mutually opposite sides of a verticle plane bisecting the eccentric heel (2).

3. Fastening strap according to claim 1, characterized in that the strap is equipped with a profiled piece (41) made of synthetic material and equipped with two curved arms (42, 43), by means of which it is fastened by gripping to the vertical rectilinear part (1) of the strap, above the said eccentric heel (2), the profile of the profiled piece coinciding with the profile of the strap at the height of the eccentric heel.

4. Fastening strap according to claim 3, further comprising in combination, an abutment made of insulating material (52:63) fastened to an intermediate support (51) extending upwardly from the tie.

5. Fastening strap according to claim 4, characterized in that the intermediate support (51) is in the form of an inverted U-shaped bow of rectangular profile.

6. Fastening strap according to claim 5, characterized in that the abutment (52) has a general rectangular form and has a profile such that the abutment is engageable laterally onto the support (51).

7. Fastening strap according to claim 5, characterized in that the abutment (63) has a profile allowing it to be fastened to the support by vertical snapping.

8. Fastening strap according to claim 7, characterized in that the abutment is equipped with a lateral tongue (66) intended to be gripped between the rail and the main bearing point (10) of the strap.

9. Fastening strap according to claim 1, characterized in that, the main bearing point (10), has a flat forming a bearing surface.

10. Fastening strap according to claim 1, further comprising in combination a centering abutment (38) having a hole (40) through which the vertical rectilinear part (1) of the strap passes, characterized in that the perimeter of the upper face of the abutment (38) is contained between the circle of revolution of the intermediate bearing point (6) and the circle of revolution of the main bearing point (10).

11. Fastening strap according to claim 10, characterized in that the lower and upper faces of the abutment are mutually parallel.

12. Fastening strap according to claim 11 characterized in that the abutment (38) possesses, on one side, a bearing surface (39) intended to be gripped between the intermediate bearing point (6) of the strap and the tie.

13. Fastening strap according to claim 11, characterized in that the abutment is made of synthetic material.

14. Fastening strap according to claim 11, characterized in that the tie (28) has, for each rail, a recess (33) intended for receiving the rail and two receptacles (32, 33) which are laterally adjacent to this recess and in which the abutments (38) are seated, the tie having a ramp (30, 31) extending at least between that edge of the said receptacles opposite the recess intended for the rail and the edge of this recess (33), these ramps forming the ramps intended for tensioning the straps, and means (34) embedded in the tie for the retention of the straps.

15. Fastening strap according to claim 14, characterized in that the means for the retention of the straps are composed of sockets made of synthetic material and having a profile for anchoring in the tie.

16. Fastening strap according to claim 1, wherein the vertical rectilinear part (1) passes through a hole (26) provided in a metal sole plate and catches on a countersink (27) into which the said hole opens, the sole plate having a receptacle (13) intended for receiving the rail and, on each side of this receptacle, ramps (24) the extension of which coincides with the flange of the rail, characterized in that the said ramps (24) have the form of a path in an arc of a circle, the mean radius of which is equal to the radius of revolution of the main bearing point (10) of the straps.

17. Fastening strap according to claim 16, characterized in that the surface (20) on the inside of the ramp in the form of an arc of a circle is plane and horizontal in the region of the upper end of the ramp.

* * * * *